US005452657A

United States Patent [19]

Kurz

[11] Patent Number: 5,452,657

[45] Date of Patent: Sep. 26, 1995

[54] TEMPERATURE CONTROL SYSTEM FOR PRINTING PRESS CYLINDERS

[75] Inventor: Hans-Joachim Kurz, Grossaitingen, Germany

[73] Assignee: Baldwin-Gegenheimer GmbH, Germany

[21] Appl. No.: 286,623

[22] Filed: Aug. 5, 1994

[30] Foreign Application Priority Data

Aug. 10, 1993 [DE] Germany ..... 43 26 835.8

[51] Int. Cl.[6] ..... B41F 5/00

[52] U.S. Cl. ..... 101/216; 101/487; 62/411; 62/412

[58] Field of Search ..... 101/216, 487, 101/488, 212, 219; 62/411, 412

[56] References Cited

U.S. PATENT DOCUMENTS

| | | | |
|---|---|---|---|
| 2,319,853 | 5/1943 | Darham | 101/488 |
| 2,651,992 | 9/1955 | Sauberlich | 101/488 |
| 4,627,345 | 12/1986 | Watts | 101/119 |
| 5,074,213 | 12/1991 | Kurosawa | 101/487 |
| 5,178,064 | 1/1993 | Kerbert et al. | 101/487 |
| 5,309,838 | 5/1994 | Kurz | 101/490 |
| 5,375,518 | 12/1994 | Kurz | 101/487 |

FOREIGN PATENT DOCUMENTS 4202544 8/1993 Germany .

OTHER PUBLICATIONS

JP 56–127457 A.In: Patents Abstracts of Japan, M–106, Jan. 12, 1982, vol. 6/No. 4; N. N. Kuhle Luft fur trockenen Druck. In: druck print, Aug. 1993, p. 30.

Beitel, U.: Eine breite Einfuhrung des wasserlose Offset-drucks erfordert innovative Losungen. In: Deutscher Drucker, Nor. 46/1992, pp. 10, 12.

N. N.: Der Trockenoffsetdruck mit MAN–Druckmaschinen.In: Druckwelt Oct. 1993, pp. 37, 38.

*Primary Examiner*—Eugene H. Eickholt
*Attorney, Agent, or Firm*—Ostrolenk, Faber, Gerb & Soffen

[57] ABSTRACT

A temperature control system for printing press cylinders. It contains at least one compressed-air line (18) having at least one blast-air opening (20) for blowing cold air against a cylinder (6) which is to be cooled. At least one recirculation circuit (30, 32, 34, 36, 28) which is separate from the cold air of the compressed-air line (28) and by which air which has been blown by the blast-air opening (20) onto the cylinder is drawn off by means of a blower (28) contained in the recirculation circuit and is blown parallel to the cold air again onto the cylinder (6). In this way, the temperature of the cold air (22) can be active, without prior change of temperature, on the cylinder (6). The cold air deflected by the cylinder is returned to the cylinder (6) for additional cooling.

19 Claims, 3 Drawing Sheets

TEMPERATURE CONTROL SYSTEM FOR PRINTING PRESS CYLINDERS

BACKGROUND OF THE INVENTION

The present invention relates to a temperature control system for printing press cylinders and particularly to a system for blowing cooling air and recirculating the cooling air.

The invention is particularly suitable for offset printing presses. The cylinders of printing presses heat up during operation and they can be cooled by air which is blown onto the outer surfaces of the cylinders. The air is cooled to a desired temperature in a cold air generator by a heat exchanger. If the cooled air is warmer than the cylinders of the press when the press starts operation, the air effects a faster heating of these printing press cylinders to the desired operating temperature. After the operating temperature has been reached, if the temperature of the printing press cylinders increases further, the air cools the printing press cylinders. Printing cylinders which are to be heated or cooled are, in particular, printing plate cylinders, rubber-blanket cylinders, impression cylinders, and inking rolls which transfer the printing ink from a source of ink to the printing plate cylinder. Good qualities of print are obtained when a printing plate cylinder has a temperature of between 24° and 27° C.

Comparable temperature control systems are known from Japanese Patent Application Publications Nos. 56-127457 and 1-72846; EPO 480 230 A1, U.S. Pat. No. 1,749,316, GB 1 534 340, German OS 19 53 590 and German OS 35 41 458 A1.

SUMMARY OF THE INVENTION

The object of the invention is to obtain a more efficient temperature control of the press cylinders. Another object of the invention is to require less cooling energy and to more rapidly adapt the temperature of the cylinders which is to be controlled to the desired temperature value.

The invention comprises at least one, and preferably several, jets of cold air arranged in a line along the cylinder, being cooled and the jets are blown at relatively high pressure from the air blast openings of a compressed air line against the outer surface of a printing press cylinder whose temperature is to be controlled. Cold air which is deflected by the cylinder is drawn by suction into a recirculation circuit and is again blown, in an air path separate from the jets of cold air, onto the outer surface of the cylinder to be cooled. The air of the recirculation circuit is not mixed with the cold air which is blown onto the cylinder but can mix with it only after contact with the cylinder and the air is then recirculated again.

The cold air from the main air blast pipe moves out from the circumferential region of initial contact with the cylinder being cooled. Also, air from the recirculation circuit outlet contacts the cylinder circumferentially outward of the region contacted by the air blast. Further, air is removed from at the surface of the cylinder circumferentially beyond the two air flows toward the cylinder.

Part of the cold air blown on the cylinder and part of the recirculated air are preferably fed to the air inlet of a cold air generator, which cools the air so that it can then be blown again as cold air onto the cylinder. The air which is returned to the cold air generator can either be taken from the recirculation circuit or can be the leakage stream which escapes between the outer surface of the cylinder to be cooled and the cooling air device by which the cold air and the recirculated air are blown onto the outer surface of the cylinder.

Other features and advantages of the present invention will become apparent from the following description of the invention which refers to the accompanying drawings.

DETAILED DESCRIPTION OF THE INVENTION

Figure 1:
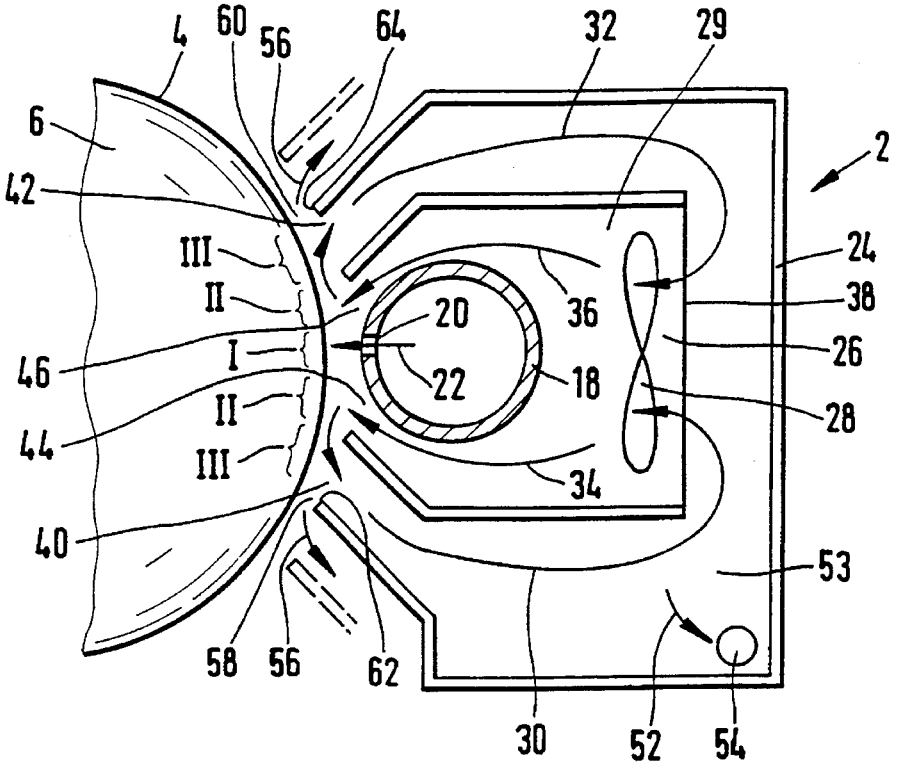
FIG. 1 is a diagrammatically shows a cross section through part of a temperature control system of the invention.
Figure 2:
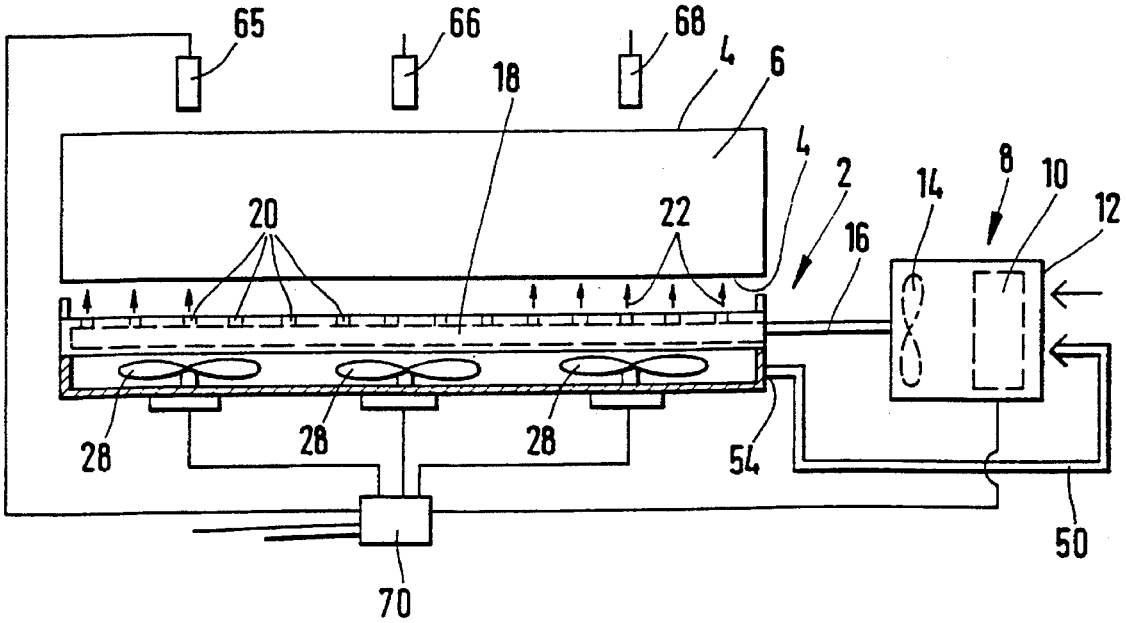
FIG. 2 is a diagrammatic longitudinal view of the temperature control system for printing press cylinders of FIG. 1.

The temperature control system for printing press cylinders shown in FIGS. 1 and 2 comprises a cold air device 2 which is arranged opposite the outer surface 4 of a cylinder 6 to be cooled and extends substantially over the entire length of the cylinder. A cold air generator 8 is arranged on the outside of the cold air device. The cold air generator 8 contains a heat exchanger 10 having a coolant circuit for cooling air which flows from an air inlet 12 through the heat exchanger 10. The air is fed by a blower 14 associated with the cold air generator via a cold air feed line 16, to a compressed air line 18 of the cold air device 2. The compressed air line 18 extends over the length of the cylinder 6. It is provided with a plurality of air blast openings or nozzles 20, which are arranged at a small distance from the outer surface 4. The openings or nozzles blow cold air at high pressure and with a high rate of flow against the outer surface 4 of the cylinder 6 whose temperature is to be controlled. The cold air blown onto the cylinder 6 is indicated diagrammatically by arrows 22.

The cold air device 2 comprises an outer housing 24, an inner housing 26 arranged spaced apart from and inside the housing 24, a pipe spaced in from the inner housing 26 which forms the compressed air line 18, and a blower 28 located on the side of the compressed air line 18 facing away from the cylinder 6. The pressure side 29 of the blower 28 faces in the direction of the compressed air line 18 and the cylinder 6. The outer housing 24, the inner housing 26, and the compressed air line 28 are spaced apart but can be mechanically connected to each other at the ends. The blower 28 is shown diagrammatically as a fan blade. Depending on the length of the cylinder 6, one or more blowers 28 can be arranged alongside each other along the longitudinal direction of the cylinder. For example, in FIG. 2, three blowers 28 are arranged alongside of each other over the length of the cylinder 6.

For each blower 28, the space between the outer housing 24 and the inner housing 26 forms two respective suction branches 30, 32 which are parallel to each other. The space between the inner housing 26 and the compressed air line 18 forms two respective pressure branches 34 and 36 which are parallel to each other. The suction branches 30 and 32 and the pressure branches 34 and 36 together form an internal air recirculation circuit having two circuit branches which are parallel to each other and which, together, have a common blower 28. One circuit branch includes the lower suction branch 30 and the lower pressure branch 34, and the other circuit branch includes the upper suction branch 32 and the upper pressure branch 36. The longitudinal side 38 of the inner housing 26 facing away from the cylinder 6 is open and forms, for both circuit branches 30, 34 and 32, 36, the inlet to the corresponding blower 28.

The cooled air in the compressed air line 18 flows through the air blast openings 20 onto a first angular region I of the outer surface 4 of the cylinder 6. Circumferentially directly along each side of the first angular region I, there is a respective second angular region II of the cylinder 6 onto which recirculated air from recirculation outlets 44 and 46 of the pressure branches 34 and 36 of the internal recirculation circuit is blown by means of the blower 28. The two recirculation outlets 44 and 46 are shown above and below, directly adjacent the air blast openings 20 and are upstream and downstream of the openings 20 with respect to rotation of the cylinder.

Directly adjacent and below the lower recirculation outlet 44, there is a lower recirculation inlet 40 of the lower suction branch 30 which is opposite a lower third angular region III of the cylinder 6. Directly adjacent and above the upper recirculation outlet 46 there is an upper recirculation inlet 42 of the upper suction branch 32 for drawing air off from an upper third angular region III of the cylinder 6. Cold air 22 from the blast air openings or nozzles 20 and recirculated air from the recirculation outlets 44 and 46 are deflected in each case on the outer surface of the cylinder 6 around the circumference of the cylinder, are thereupon mixed with each other, and are then drawn off by the blower 28 through the recirculation inlets 40 and 42, and blown through the blower 28 via the pressure branches 34 and 36 and the outlets 44 and 46 again onto the outer surface 4 of the cylinder 6.

Excess air is produced in the cold air device 2 as a result of the freshly entering cold air 22. The excess air is drawn back via a suction line 50 from the blower 14 of the cold air generator 8 to its air inlet 12, is cooled by heat exchanger 10 and is again fed by the cold air feed line 16 to the compressed air line 18. In this way, an external cooling circuit for the air is formed by the cold air generator 8, its cold air feed line 16, and its suction line 50. Through the suction line 50 of the cold air generator 8, air 52, which has been heated by the cylinder 6, can be drawn out of the space 53 between the outer housing 24 and the inner housing 26 via a suction opening 54 formed in the outer housing 24, and/or air 56 heated by the cylinder 6 can be drawn out of a lower slot 58 and an upper slot 60 which are formed between the outer surface 4 of the cylinder 6 and an opposite lower edge 62 and upper edge 64 of the outer housing 24. The edges 62 and 64 of the outer housing 24 also form the outer limits of the recirculation inlets 40 and 42 and they extend lengthwise of the cylinder 6.

The speed of rotation of the blower 28 of the internal recirculation circuit and/or the speed of rotation of the blower 14 of the cold air generator 8 in the external recirculation circuit and/or the temperature of the coolant in the heat exchanger 10 can be adjusted and controlled by a microprocessor 70 as a function of contactless temperature sensors 65, 66 and 68. The temperature sensors 65, 66 and 68 are arranged distributed over the length of the cylinder 6 and measure the temperature of its outer surface 4 without contact.

Figure 4:
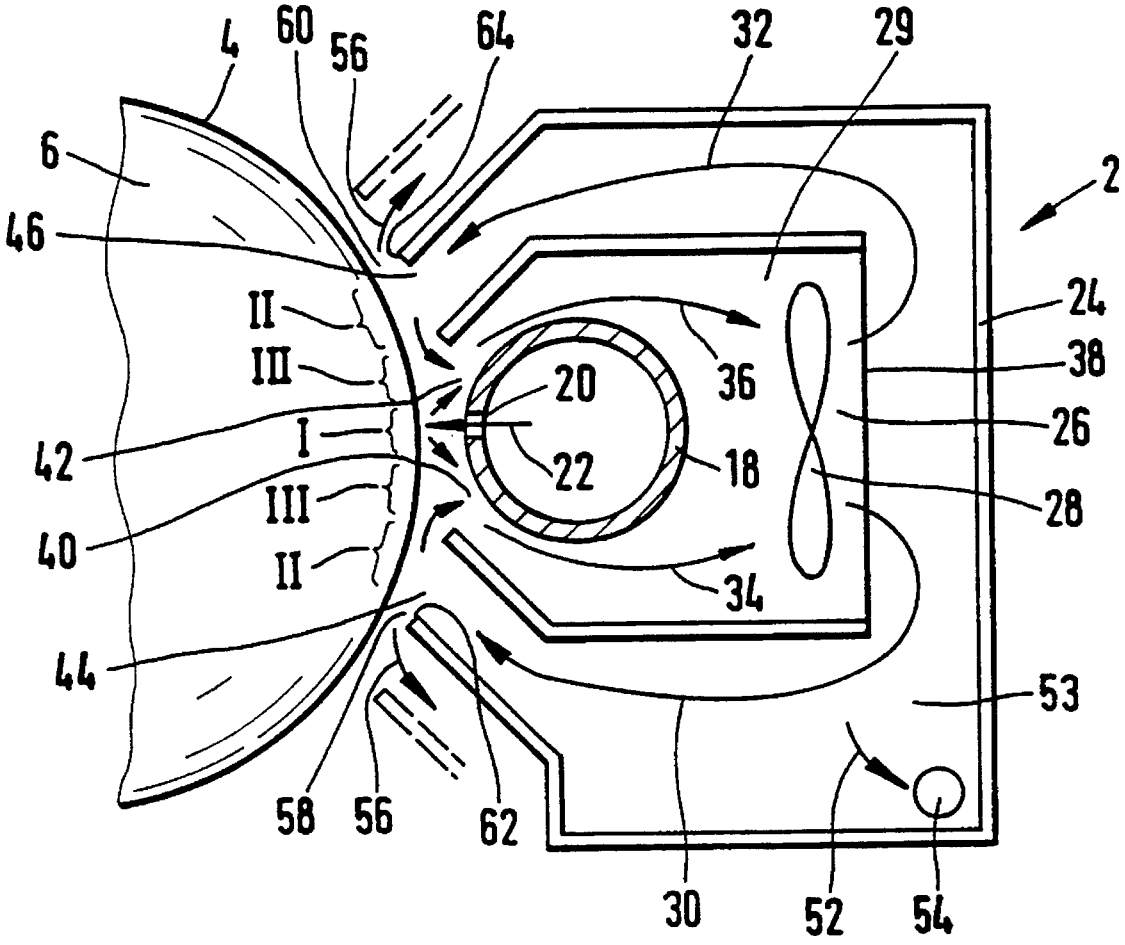
FIG. 4 is a diagrammatic view like FIG. 1 thorough a further embodiment of the invention.

In a further embodiment of the invention shown in FIG. 4, the positions of the recirculation inlets 40 and 42 and positions of the recirculation outlets 44 and 46 are interchanged relative to the embodiment of FIG. 1, so that the recirculation inlets 40, 42 lie between the blast air opening 20 and the recirculation outlets 44, 46 and the positions of the third and second angular regions are also exchanged so that each third region III is between a second region II and the first region I. One way of achieving that is to reverse the blower direction, as illustrated in FIG. 4, from the blower direction in FIG. 1.

Figure 3:
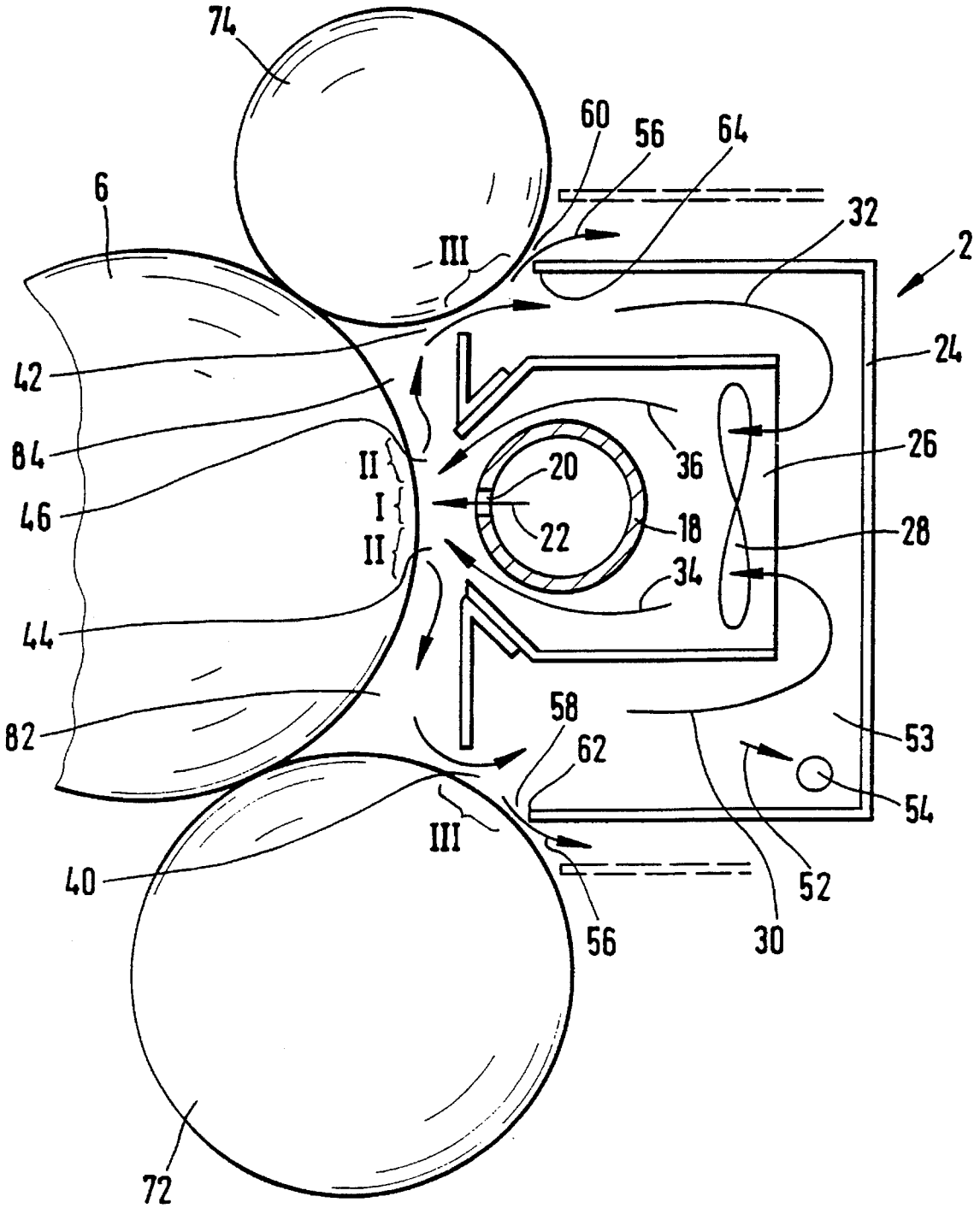
FIG. 3 is a diagrammatically shows a cross section, similar to FIG. 1, through another embodiment of the invention.

The temperature control system can be used to cool a plurality of cylinders. In the embodiment shown in FIG. 3, a cooling device 2 is provided which is substantially identical to the cold air device 2 of FIGS. 1 and 2, and corresponding parts are provided with the same reference numerals. The cooling air device 2 of FIG. 3 blows cold air 22 through the air blast openings or nozzles 20 onto a first angular region I of the circumference of a middle cylinder 6 which is, for instance, a printing plate cylinder. On the middle cylinder 6 there rests a lower cylinder 72, for instance an impression cylinder, and an upper cylinder 74, for instance an inking roller. The two recirculation outlets 44 and 46 are arranged on both circumferential sides adjacent the air blast openings or nozzles 20, and the two second angular regions II adjoin the first angular region I on the middle cylinder 6. Of the two recirculation inlets 40 and 42, one inlet 40 is formed above the lower cylinder 72 for drawing off cooling air from a third angular region III of the circumference of the lower cylinder 72, and the other inlet 42 is formed over the upper cylinder 74 for the drawing off cooling air from a third circumferential region III of the upper cylinder 74. The three angular regions I, II and III are connected together by a lower channel 82 and by an upper channel 84. Each of those channels is formed by the cylinders 6, 72 and 74 or the cooling air device 2/2 opposite them.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A temperature control system for a printing press cylinder comprising an air blast device comprising a compressed air line, at least one air blast opening defined in the compressed air line for blowing cold air therethrough and onto a first circumferentially angular region of the circumference of the cylinder opposite the blast air opening;

an air recirculation circuit which is separate from the compressed air line, and comprising:

means defining a recirculation air outlet for blowing recirculated air onto a second circumferentially angular region of the cylinder, which lies circumferentially to the side of the first circumferentially angular region;

further means defining a recirculation air inlet placed at a third region circumferentially angularly to the side of the first and second regions of the cylinder, on which the blast air opening and the recirculation air outlet direct air, the air inlet being for receiving air deflected from the first and second regions of the cylinder; and a blower between the recirculation air inlet and the recirculation air outlet for removing the air from the third region through the air inlet, recirculating the air through the blower and blowing the recirculated air out the recirculation air outlet.

2. The temperature control system of claim 1, wherein the air blast opening, the recirculation inlet and the recirculation outlet are so placed circumferentially around the cylinder that the second angular region lies between the first angular region and the third angular region.

3. The temperature control system of claim 1, wherein the air blast opening, the recirculation inlet and the recirculation outlet are so placed that the third angular region lies between the first angular region and the second angular region.

4. The temperature control system of claim 1, wherein the compressed air line extends substantially over the entire length of the cylinder and has the blast air openings extending substantially over the length of the cylinder; and the recirculation circuit extends substantially over the entire length of the cylinder.

5. The temperature control system of claim 1, wherein the recirculation circuit is disposed so as to be wrapped around the compressed air line; the blower being arranged on the side of the compressed air line away from the cylinder; and the recirculation circuit including a circuit section which extends from the blower around the compressed air line to the cylinder.

6. The temperature control system of claim 1, further comprising a second recirculation circuit comprising a cold air generator for generating cold air, a blower for blowing the generated cold air through the second recirculation circuit;

the compressed air line being connected in the second recirculation circuit for receiving cold air from the blower; and a suction line positioned for drawing air off from the recirculation circuit and returning the drawn off air to the cold air generator for cooling thereof.

7. The temperature control system of claim 6, wherein the recirculation circuit includes a cooling air device which extends substantially over the entire length of the cylinder.

8. The temperature control system of claim 7, wherein there are several cylinders at the cooling air device and the cooling air device extends substantially over the entire length of the several cylinders and the recirculation circuit causes cooling air to blow over the circuit cylinders.

9. The temperature control system of claim 1, wherein there is a respective second angular circumferential region of the first cylinder at the opposite circumferentially angular sides of the first region, to be on the upstream and downstream sides of the first angular region with reference to the rotation of the cylinder;

two of the recirculation air inlets respectively on the opposite circumferentially angular sides of the first region;

two of the recirculation air outlets respectively on the opposite circumferentially angular sides of the first angular region; and the cylinder having a respective third circumferentially angular region at each side of the first angular region thereof.

10. The temperature control system of claim 9, wherein the recirculation circuit is disposed to be wrapped around the compressed air line; the blower of the recirculation circuit being arranged at the side of the compressed air line away from the cylinder;

at both circumferentially angular sides of the blast air opening from the compressed air line, the recirculation circuit having a respective circuit section which extends from the blower around the compressed air line to the outer surface of the cylinder circumferentially outward of the first circumferentially angular region of the cylinder.

11. The temperature control system of claim 10, wherein the recirculation circuit at each circumferential side of the compressed air line defines respective parallel circuit branches, and each circuit branch has a respective recirculation inlet, located upstream of and downstream of the blast air opening from the compressed air line with reference to the direction of rotation of the cylinder.

12. The temperature control system of claim 11, wherein the blower is a common blower for both of the circuit branches of the recirculation circuit and the respective recirculation inlets and circuit branches of the recirculation circuit are connected for flow to the suction side of the blower.

13. The temperature control system of claim 11, wherein the circuit branches of the recirculation circuit each have a respective recirculation outlet, one of the recirculation outlets being circumferentially upstream and the other being downstream of the air blast opening of the compressed air line, with reference to the rotation direction of the cylinder.

14. The temperature control system of claim 13, wherein the recirculation outlets of the two branches of the recirculation circuit are connected for air flow to the pressure side of the same blower in that circuit.

15. The temperature control system of claim 11, wherein there is a respective second angular circumferential region for each of the circuit branches, and each second angular region lies between the single first angular region from the blast air nozzle and the respective third angular region for each of the branches.

16. The temperature control system of claim 15, further comprising a second recirculation circuit comprising a cold air generator for generating cold air, a blower for blowing the generated cold air through the second recirculation circuit;

the compressed air line being connected in the second recirculation circuit for receiving cold air from the blower; and a suction line positioned for drawing air off from the recirculation circuit and returning the drawn off air to the cold air generator for cooling thereof.

17. The temperature control system of claim 11, wherein the recirculation inlet is between the air blast opening and the recirculation outlet.

18. The temperature control system of claim 11, wherein the recirculation outlet is between the air blast opening and the recirculation inlet.

19. The temperature control system of claim 8, wherein there are three of the cylinders on which the temperature control system operates, including a central cylinder having at least the first and second circumferentially angular regions and a respective third cylinder at each side of the first region at which the respective one of the third regions is defined, the recirculation circuit inlet being at the additional two cylinders.

* * * * *